US007150688B1

(12) United States Patent
Coulbourn

(10) Patent No.: US 7,150,688 B1
(45) Date of Patent: Dec. 19, 2006

(54) EXTENDABLE RETRACTABLE BARRIER

(76) Inventor: Wayne Coulbourn, 383 Corn Crib Rd., Harrington, DE (US) 19952

( * ) Notice: Subject to any disclaimer, the term of this patent is extended or adjusted under 35 U.S.C. 154(b) by 0 days.

(21) Appl. No.: 11/047,537

(22) Filed: Jan. 31, 2005

(51) Int. Cl.
*A63B 67/00* (2006.01)

(52) U.S. Cl. ..... 473/415

(58) Field of Classification Search ..... 473/415, 473/422, 421, 454–456, 459, 469, 473; 273/348, 273/395, 406, 375; 434/66
See application file for complete search history.

(56) References Cited

U.S. PATENT DOCUMENTS

| | | | | |
|---|---|---|---|---|
| 364,175 | A | 5/1887 | Hurd | |
| 1,844,447 | A | 10/1932 | White | |
| 2,884,252 | A * | 4/1959 | Thompson | 473/477 |
| 3,086,430 | A | 4/1963 | Emmel | |
| 3,530,775 | A | 9/1970 | Bowersox | |
| 4,121,356 | A * | 10/1978 | Gambon | 434/66 |
| 4,490,068 | A * | 12/1984 | Dickinson | 404/6 |
| 4,576,507 | A | 3/1986 | Terio | |
| 4,666,331 | A | 5/1987 | Riley | |
| 6,099,200 | A | 8/2000 | Pepe et al. | |
| 6,345,930 | B1 | 2/2002 | Mohassel | |
| 6,626,606 | B1 | 9/2003 | Johnson | |

FOREIGN PATENT DOCUMENTS

| | | |
|---|---|---|
| FR | 2759103 | 8/1998 |
| FR | 2760763 | 9/1998 |

* cited by examiner

*Primary Examiner*—Mitra Aryanpour
(74) *Attorney, Agent, or Firm*—Michael I Kroll

(57) ABSTRACT

A protective barrier for use on a baseball field that is actuated by motion sensors that are housed within a structured base. The protective barrier is actuated when a projectile such as a baseball travels through the sensors line of sight. The barrier serves to sense when a line drive is hit towards a pitcher and will rapidly extend to block the baseball and greatly reduce the possibility of harm to the pitcher.

15 Claims, 8 Drawing Sheets

EXTENDABLE RETRACTABLE BARRIER

BACKGROUND OF THE INVENTION

1. Field of the Invention

The present invention relates generally to protective shield device and, more specifically, to extendable/retractable motion sensor based barrier derived to shield pitchers from line drives.

The device is comprised of a protective barrier that is actuated by motion sensors that are housed within a structured base. The protective barrier is actuated when a projectile travels through the sensors line of sight. The barrier should be furnished from a rigid yet sturdy material capable of sustaining direct impact from a projectile traveling at great speeds.

2. Description of the Prior Art

There are other extendable and retractable devices designed for the same purpose. Typical of these is U.S. Pat. No. 364,175 issued to Hurd on May 31, 1887.

Another patent was issued to White on Apr. 25, 1932 as U.S. Pat. No. 1,884,447. Yet another U.S. Pat. No. 3,086,430 was issued to Emmel on Apr. 23, 1963 and still yet another was issued on Sep. 20, 1970 to Bowersox et al as U.S. Pat. No. 3,530,775.

Another patent was issued to Terio on Mar. 18, 1986 as U.S. Pat. No. 4,576,507. Yet another U.S. Pat. No. 4,666,331 was issued to Riley on May 19, 1987. Another was issued to Pepe et al on Aug. 8, 2000 as U.S. Pat. No. 6,099,200 and still yet another was issued on Feb. 12, 2002 to Mohassel as U.S. Pat. No. 6,345,930.

Another patent was issued to Johnson on Sep. 30, 2003 as U.S. Pat. No. 6,626,606. Yet another French Patent No. FR2759103 A1 was issued to Yves on Aug. 7, 1998. Another was issued to Bernard on Sep. 18, 1998 as French Patent No. FR2760763 A1.

U.S. Pat. No. 364,175

Inventor: C, S Hurd

Issued: May 31, 1887

The combination of sliding hitching post having the spring pintle and enclosing case having the locking sleeve provided with suitable seat, and having the inclines face above said seat, adapted to press the spring pintle into the sliding post so that the same may be lowered, substantially as set forth.

U.S. Pat. No. 1,884,447

Inventor: L. J. White

Issued: Apr. 25, 1932

Thos invention relates to vehicle barriers or safety stops and, among other objects, aims to provide stop members adapted to projected, at will, into the path of traffic for the protection of gate entrances and the like.

U.S. Pat. No. 3,086,430

Inventor: D. T. Emmel

Issued: Apr. 23, 1963

This invention relates to equipment for the control of traffic and in particular relates to equipment for changing the number of traffic lanes as between the opposite sides of a highway or altering the lane pattern on either side.

U.S. Pat. No. 3,530,775

Inventor: Joseph W. Bowersox ET el

Issued: Sep. 29, 1970

A pop up traffic divider for use on a highway has a housing buried flush with the highway and containing a casing also flush with the highway and encompassing a column supported on the casing bottom and at top flush with the highway. An annular piston is disposed between the casing and the column and is moved up and down by differential pressure of fluid such as air. On the piston is a resilient, deformable tube retracted within the casing and expelled there from by movement of the piston. The upper end of the column and of the casing afford a rounded body or bodies over which the extended, deformable and resilient tube can be bent without injury.

U.S. Pat. No. 4,576,507

Inventor: Charles J. Terio

Issued: Nov. 28, 1984

A terrorist vehicle barrier is disclosed having high strength cables stretched between two vertical I-beams. The cables are attached to the I-beams in a unique shock absorbing arrangement. The barrier is actuatable from a position below ground to effectively arrest the motion of high speed terrorist vehicle. Various means are disclosed for actuating the gate. The barrier is designed to solve esthetic problems encountered in the making a building secure from terrorist attack as well as to be strong enough to stop a high speed vehicle with minimum damage to the barrier, the vehicle, or the vehicle driver.

U.S. Pat. No. 4,666,331

Inventor: William T. Riley

Issued: May 19, 1987

An instant defense barrier for providing unobtrusive protection for a building or other site. A plurality of barrier post assemblies are anchored in the earth. Each assembly includes a barrel and a post slidably fitted in the barrel. The head end of the post portion is essentially flush with the level of the roadbed when the post is in the normal, non-extended position. When activated by closing a switch, the post is propelled from the confined position in the barrel by an explosive charge, a compression spring or other propulsive forces to a locked extended position to provide a barrier against unauthorized passage by a motor vehicle. A plurality of auxiliary cables are optionally connected between adjacent posts to provide further obstruction to the progress of small vehicles, such as motorcycles or bicycles.

U.S. Pat. No. 6,099,200

Inventor: John J. Pepe et al

Issued: Aug. 8, 2000

An energy absorbing, retractable barrier used to stop the movement of vehicles. The device is employed to control access to entranceways driveways, roads and to secure a security perimeter around buildings and objects requiring such protection. The device consists of a reinforced telescoping bollard inserted into a foundation casing, which is imbedded below ground. The device is manually operated and is extended by self-contained gas-charged spring lift mechanism. The device contains a locking mechanism for securing the telescoping bollard in the extended and retracted positions. When in the retracted position the bollard is flush with the surface and can be traversed by a vehicle. The device is of simple design, easily installed and easily maintained.

U.S. Pat. No. 6,345,930

Inventor: Parvis Mohassel

Issued: Feb. 12, 2002

A retractable versatile bollard of simple construction is made of stainless steel. The post is generally cylindrical in shape and, when the bollard is in the stored position, the post sits in a sleeve in the ground below grade level. In active position, the post can be grasped by a handle and pulled up by human effort to where only a lower portion remains submerged underground. The lower portion of the cylindrical post has spiral threading that mates with spiral grooves at an upper sleeve portion of the sleeve when the post is turned after first raising the post to an appropriate point. Bollard has a safety lock permitting the post to be raised from a stored position to an active position and a double lock that prevents it to from being easily lowered by mischievous individuals from the raised active position to the stored position.

U.S. Pat. No. 6,626,606

Inventor: Dwight David Johnson

Issued: Sep. 30, 2003

A pylon or barrier arrangement which is recessed into the ground or other surfaces and includes a post-like pylon which is moveable between an extended position for control of vehicular or pedestrian traffic, and a retracted position beneath the ground. Movement of the pylon is achieved by a linear-type drive mechanism which acts as a clutch by decoupling from an upright and rotatable smooth drive shaft during abrupt downward driving of the pylon to avoid damage to the internal components of the arrangement. A sealing arrangement is provided for preventing the entry of debris into the interior of the pylon arrangement, and a heating unit is provided for preventing seizure of the arrangement during harsh weather conditions.

French. Patent Number FR2759103

Inventor: Loisel Yves

Issued: Aug. 7, 1998

The abstract or semi-automatic protection for a car parking space has a barrier which blocks entry to the parking space, a motor which can raise or lower the barrier, an electronic circuit to control operation of the motor, a battery to provide an autonomous source of energy for installation, a housing which can be fixed to the ground to enclose the controls and the barrier, and a remote control receiver allowing control of the motor from a distance. The electric control unit can incorporate facilities to identify a unique code associated with the legitimate owner of the space. An alarm can be activated if there is any attempt to manually operate the device.

French Patent Number FR2760763

Inventor: Boucher Bernard

Issued: Sep. 18, 1998

The bollard has a retractable tube with a soldered, convex top with a screw and damper. The upper tube is soldered to the convex end and slides inside the lower tube fixed at the base by a screw. The spring to raise the bollard is housed in the upper and lower tubes and rests against a ring which in turn rests against the axis. The stop is fixed to the upper tube and is guided through the groove in the lower tube. Eight Teflon runners are attached by screws to the retractable tube and slide over the guide tube which is attached to three Silent blocs (RTM). The spring exerts vertical pressure, raising the tube to the point where it reaches the stop. The gaps restrict the amount of air which can enter compensates for the effect of the spring by absorbing the shock.

While these extending and retracting barriers may be suitable for the purposes for which they were designed, they would not be as suitable for the purposes of the present invention, as hereinafter described.

SUMMARY OF THE PRESENT INVENTION

A primary object of the present invention is to provide an extendable and retractable barrier.

Another object of the present invention is to provide an extendable and retractable barrier suitable for the protection of baseball pitcher from on coming projectiles.

Yet another object of the present invention is to provide an extendable and retractable barrier that is actuated by motion detection sensors.

Still yet another object of the present invention is to provide an extendable and retractable barrier that can be housed below ground level.

Another object of the present invention is to provide an extendable and retractable barrier that consists of a protective screen, a plurality of motion detection sensors housed within an enclosure that is embedded below ground level.

Yet another object of the present invention is to provide extendable and retractable barrier that is actuated by motion detector sensors that once activated allows the barrier to traverse vertically by mechanical means along an allocated distance.

Still yet another object of the present invention is to provide an extendable and retractable barrier that provide protection for baseball pitcher from line drive balls that may exceed the pitcher means for retrieving said ball in an appropriate manner that may cause harm to his person.

Additional objects of the present invention will appear as the description proceeds.

The present invention overcomes the shortcomings of the prior art by providing an extendable and retractable barrier for the protection of baseball pitchers from line drive balls. The extendable and retractable barrier will attempt to eliminate the hazards, which exist when a line drive ball is hit towards a pitcher in a manner, and speed in which he may be injured or seriously hurt. The extendable and retractable barrier is to be furnished from a material that may absorb the kinetic energy delivered by the bat to the ball as it struck by the batter in the direction of the pitcher. The extendable and retractable barrier is to be actuated by a plurality of motion detection sensor housed within an enclosure that assists in the makeup of the extendable retractable barrier. The extendable and retractable barrier is to be housed within the ground, and consist of a protective screen, which is connected to a chain drive mechanism, which allows the protective screen to traverse within grooves of the main housing unit. The extendable and retractable barrier is also furnished with a plurality of drive motors coupled to a chain drive system, which provides the means for the protective screen to traverse an allocated length.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
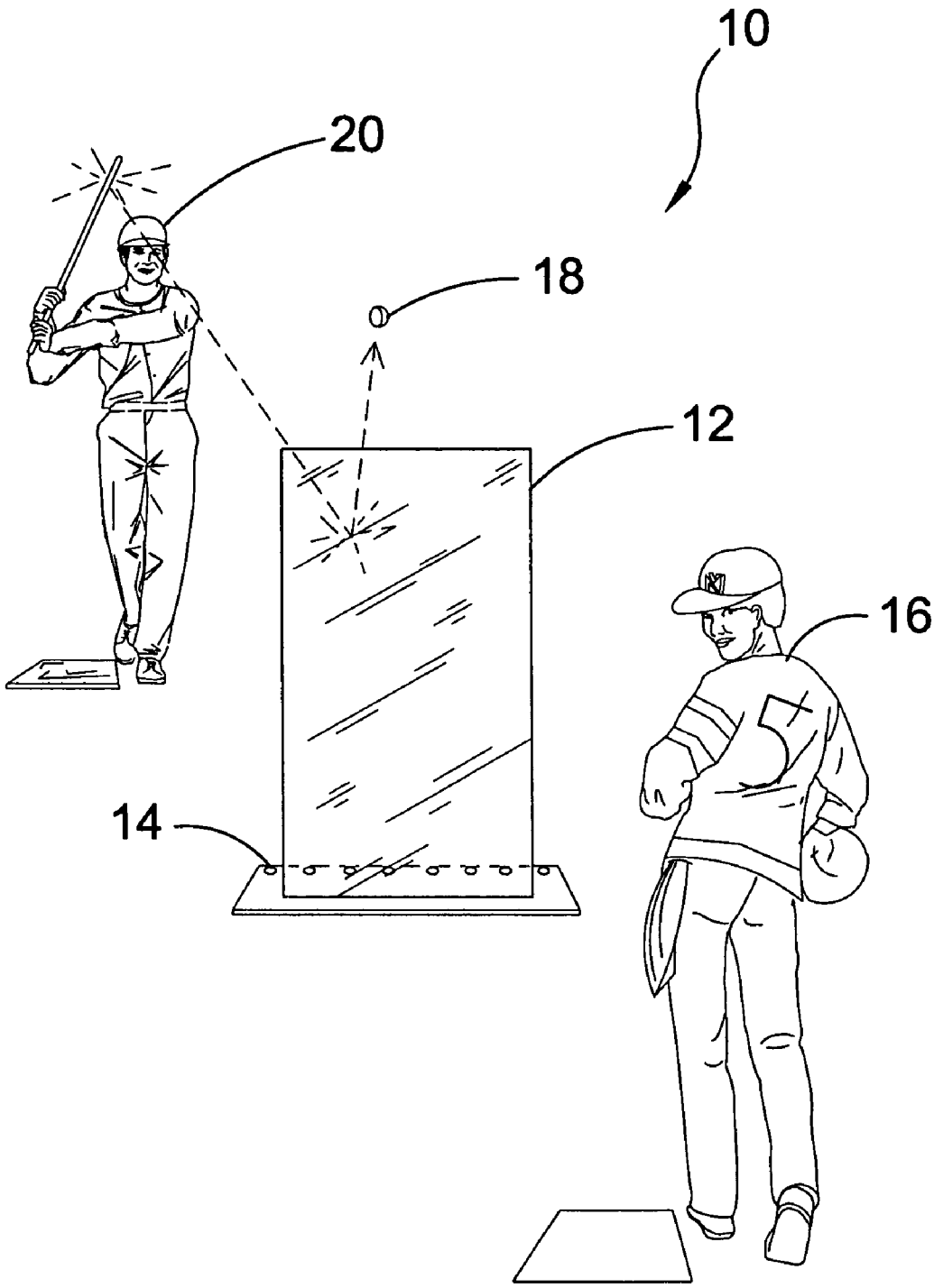
FIG. 1 is an illustrative view of the present invention in use.

Turning now descriptively to the drawings, in which similar reference characters denote similar elements throughout the several view, the figures illustrate the Extendable Retractable Barrier of the present invention. With regard to the reference numerals used, the following numbering is used throughout the various drawing figures.

10 Extendible Retractable Barrier of the present invention
12 protective screen
13 housing
14 sensors
16 pitcher
18 ball
20 batter
22 pitcher's mound
24 pitching rubber
26 home plate
28 screen mounting bracket
29 drive gear assembly
30 chain
32 seal
34 bearing block
36 motor
37 drive shaft
38 remote control
40 timer

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is the present invention 10, an extendable retractable screen 12 having motion sensors 14 responsive to projectiles for extending said barrier. Shown is a ball 18 being hit by a batter in a line drive fashion. Also shown is the screen 12 deflecting the ball 18 before it reaches the pitcher 16 thus insuring the functionality of said invention. Further shown is the intended location for the proper use of the present invention 10 to further insure that its functionality is preserved.

Figure 2:
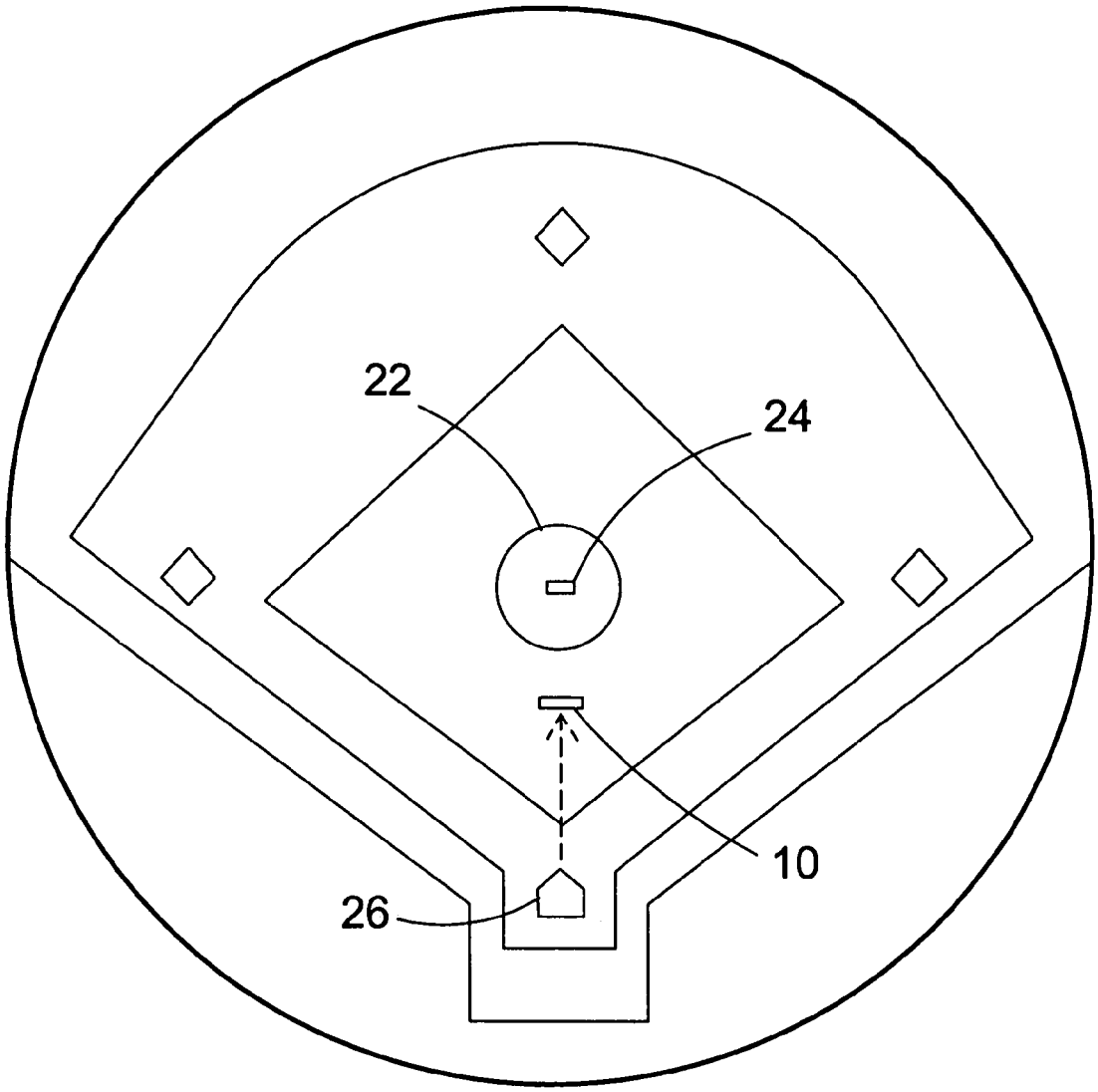
FIG. 2 is a topographical view of the placement of the present invention in use.

FIG. 2 is the present invention 10, an extendable retractable barrier having motion sensors responsive to projectiles for extending said barrier. Shown is the typical location for the present invention 10 to insure that the proper functionality is maintained. Also shown is the present invention 10 as it relates to a baseball diamond. Further shown is the typical position of the present invention 10 as it correlates to the pitchers mound 22, the pitchers rubber 24 and home plate 26. The actual distance may vary due to the overall change in field size between leagues, shown is a visual representation of the present invention 10 intended location.

Figure 3:
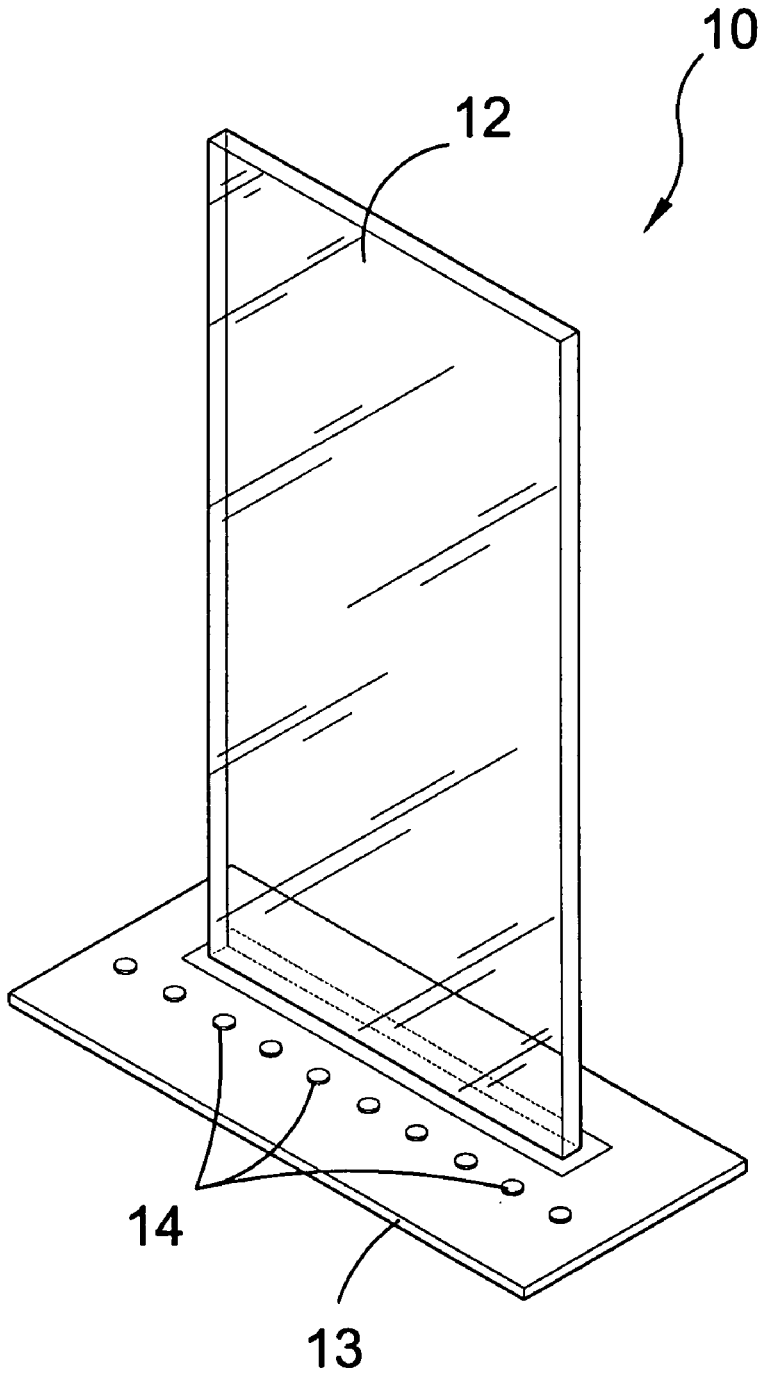
FIG. 3 is a perspective view of the present invention.

FIG. 3 shows a perspective view of the present invention 10. Shown are call outs of the items which comprise said invention. Also shown is a visual representation of the present invention 10 as it may look at the time of manufacturing and assembly. Also shown is the interrelation of the sensors 14 as they relate to the housing unit 13 of said invention 10. Further shown is the relation of the housing unit 10 as it relates to the protective screen 12. Shown is a plurality of sensors 14 that may comprise the present invention at the time of manufacturing.

Figure 4:
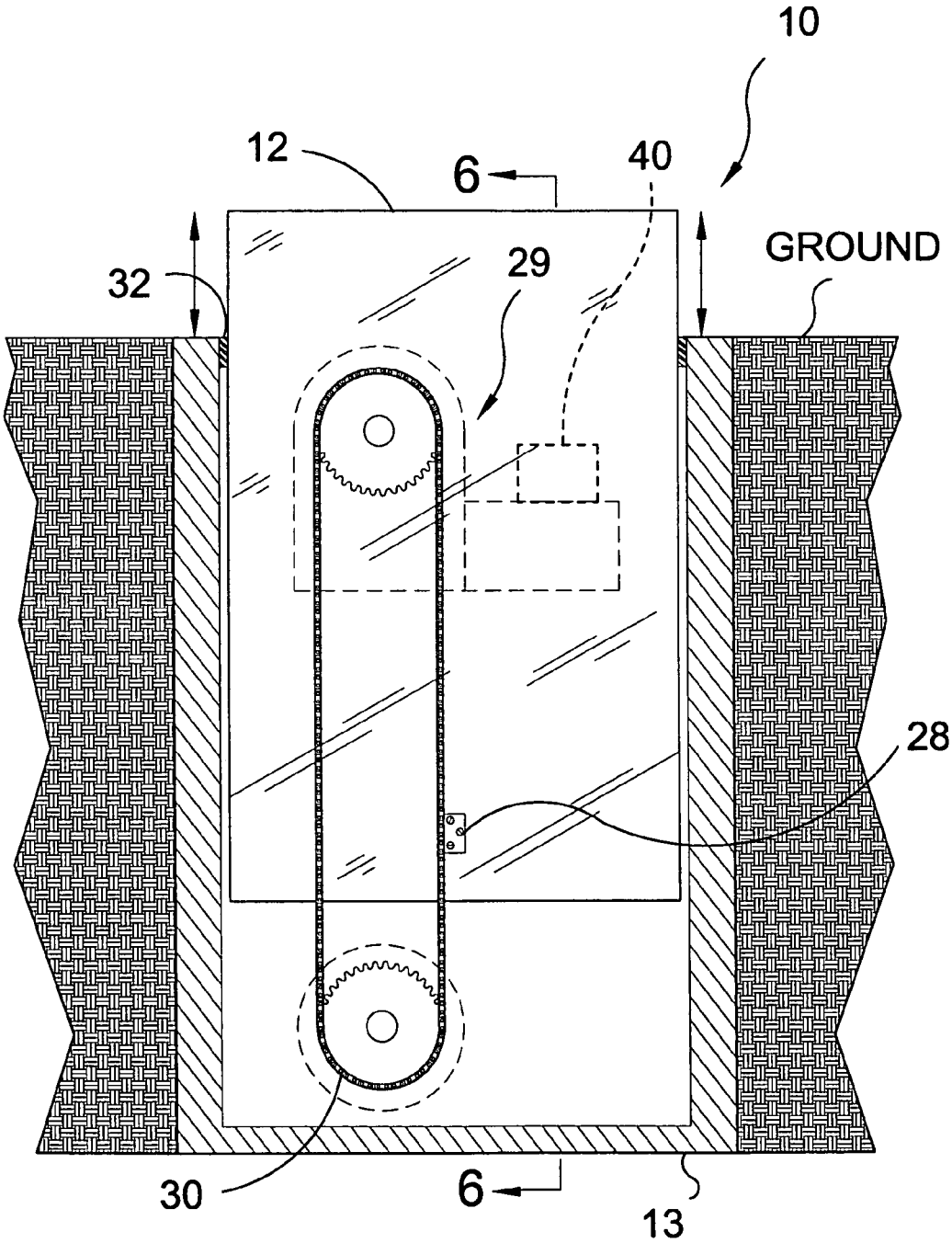
FIG. 4 is a sectional view of the present invention.

FIG. 4 is shows a sectional view of the present invention 10. Shown are call outs of several items which comprise the present invention 10. Also shown is the intended interrelation of these parts in order to obtain the functionality of said invention 10. Shown is the screen 12, and the screen mounting bracket 28 as they are furnished to the drive gear assembly 29 which will allow the screen to traverse its intended distance. Also shown is the seal 32 which is housed within the ground of the field. Further shown is the relationship between the housing 13, the seal 32 and the screen 12. A timer 40 included to retract the screen 12 after per-determined period of time once the screen 12 is extended and deployed. This sectional view is depicted to show how the present invention 10 may appear at time of assembly.

Figure 5:
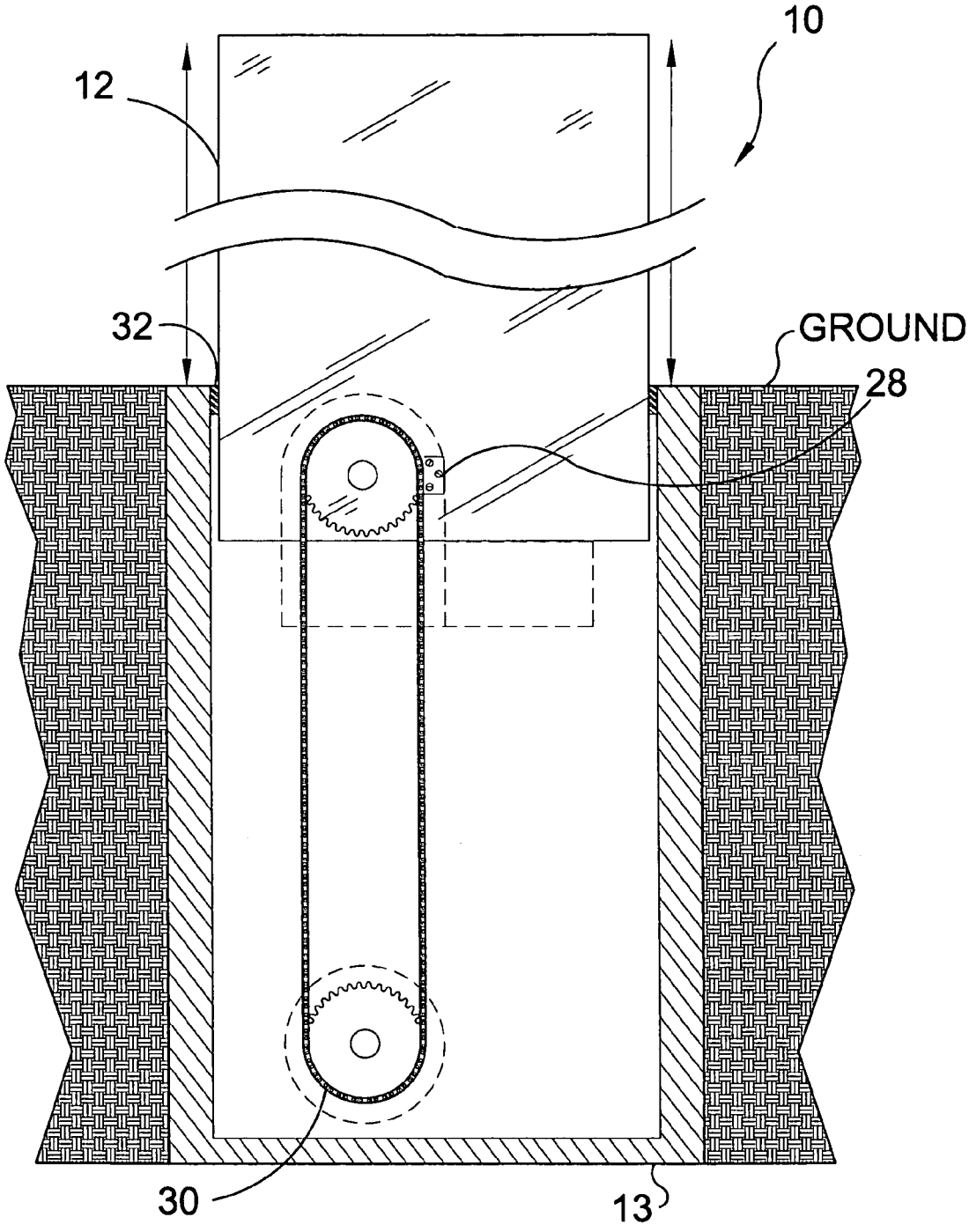
FIG. 5 is a sectional view of the present invention.

FIG. 5 shows a sectional view of the present invention 10, an extendable retractable screen 10 having motion sensors responsive to projectiles for extending said barrier. Shown is the drive mechanism 29 having raised the screen 12 to an elevated position. Said barrier having impact resistant screen 12 movable by means of chain 30 drive between a seated and extended position.

Figure 6:
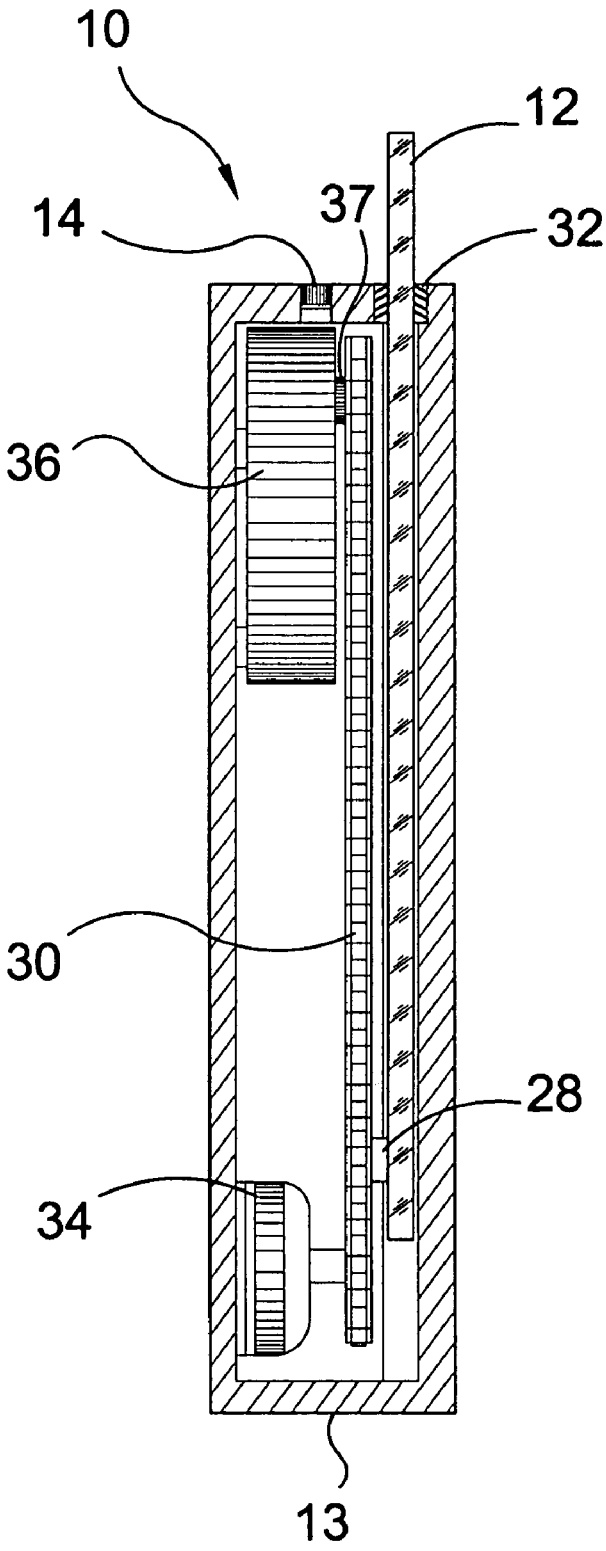
FIG. 6 is a cross section view of the present invention.

FIG. 6 is a cross section view of the present invention 10 taken from FIG. 4 as indicated. Shown is the interrelation of the components which drive the screen into its intended functional position including the motor 36 and drive shaft 37, the bearing block 34 and the chain 30 communicating therebetween. Also shown is the sensor 14 location as it relates to the main drive motor 36 of the present invention 10. Further shown is an attempt to position all the functioning parts of the present invention 10 as they may appear during manufacturing and assembly.

Figure 7:
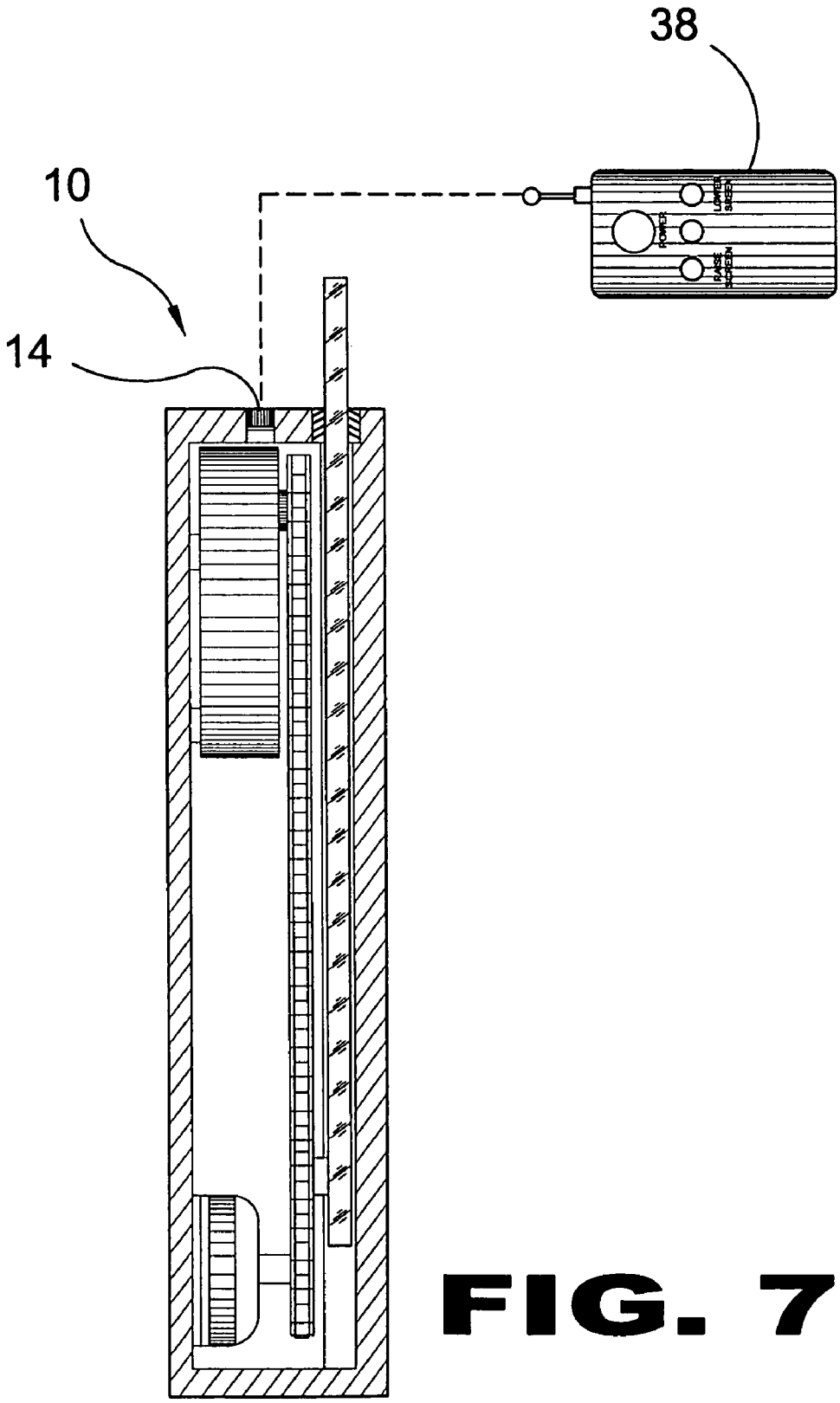
FIG. 7 is a cross section view of the present invention

FIG. 7 is a cross section view of the present invention 10 including a remote control actuator 38. The device can be operated mechanically or by hand held remote control 38 as well as using the electronic sensors 14.

Figure 8:
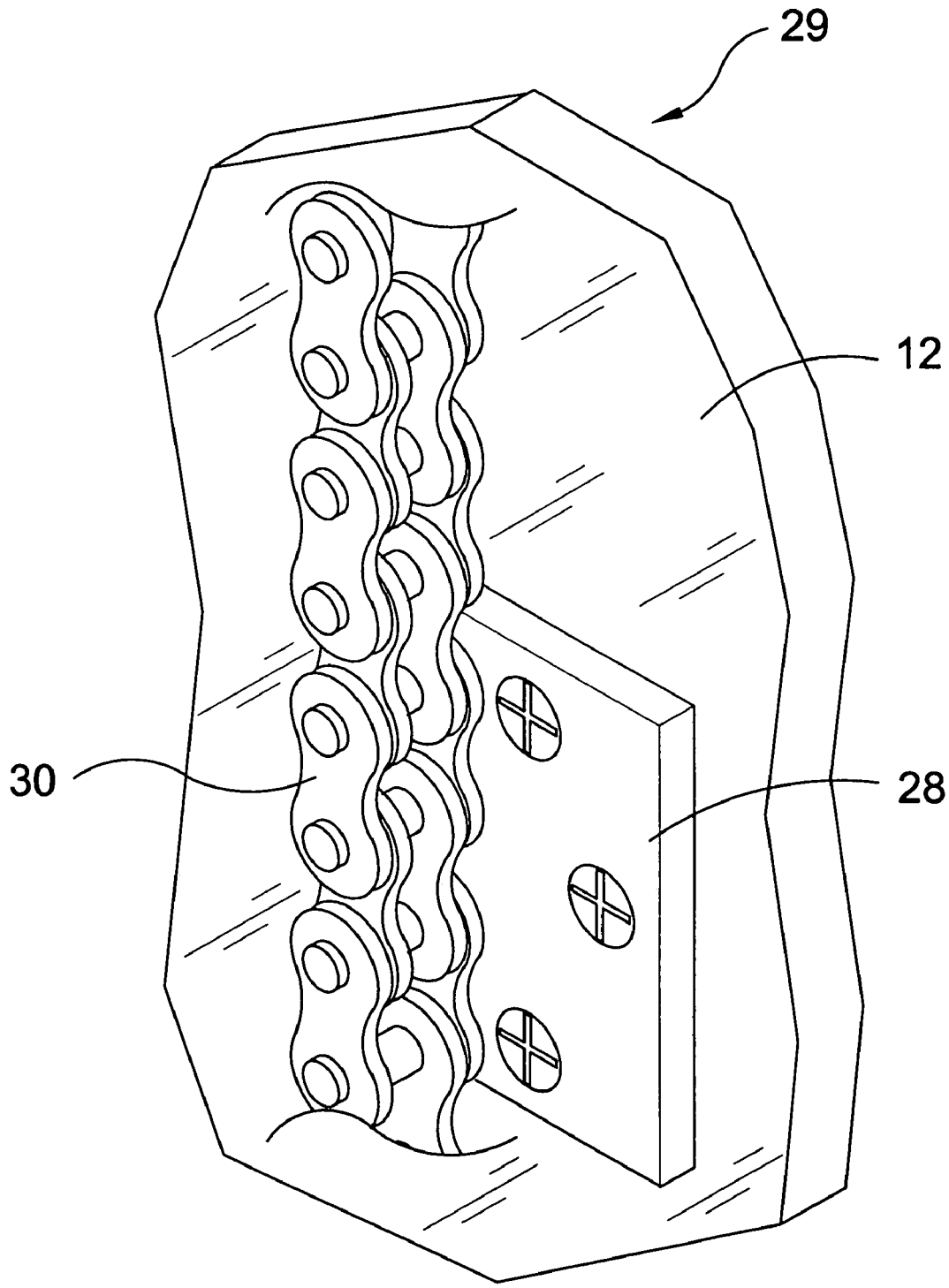
FIG. 8 is a detailed view of a section of chain drive and screen mounting bracket of the present invention.

FIG. 8 is a cross sectional view of the chain drive assembly 29 present invention. Shown is the intricate workings of the chain drive assembly 29 as the chain 30 is affixed to the screen mounting bracket 28 that is further affixed to the screen 12 with fastening means in order to insure repairability due to stress or natural wear of parts.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed is:

1. An extendible retractable barrier for protecting a baseball pitcher from line drives comprising:

a) a subterranean housing having a top portion flush with the ground;

b) a rigid screen member disposed within said housing;

c) means for vertically extending and retracting said rigid screen member so a substantial portion thereof can be situated above ground as needed;

d) sensor means for detecting the approach of a projectile approaching said screen and activating said means for extending said screen prior to said projectile surpassing said screen, wherein said extending and retracting means is a chain drive assembly, said chain drive assembly comprising:

i) a reversible motor having a drive shaft;

ii) a bearing block spaced vertically apart from said motor;

iii) a drive chain communicating between said drive and said bearing block; and iv) a screen mounting bracket affixing said drive chain to said screen.

2. An extendible retractable barrier as recited in claim 1, wherein said sensors are in electrical communication with said motor and actuate said motor when activated.

3. An extendible retractable barrier as recited in claim 2, wherein said sensors are disposed on the ground level, top portion of said housing and oriented upward to detect the presence of an overhead projectile approaching the vertical axis of said screen.

4. An extendible retractable barrier as recited in claim 3, wherein said projectile is a baseball.

5. An extendible retractable barrier as recited in claim 4, wherein said housing is subterraneanly disposed within the field of play of a baseball field.

6. An extendible retractable barrier as recited in claim 5, wherein said housing is disposed in-line between home plate and the pitching rubber of the pitching mound.

7. An extendible retractable barrier as recited in claim 6, wherein said housing is located substantially 15 feet from said pitching mound.

8. An extendible retractable barrier as recited in claim 7, wherein said sensors have a limited range for detecting the baseball thereby preventing the activation thereof in the event of a pop fly.

9. An extendible retractable barrier as recited in claim 8, wherein a line drive hit in-line from said home plate towards the pitching rubber of the pitching mound will activate said sensors.

10. An extendible retractable barrier as recited in claim 9, wherein said sensors actuate said motor thereby initiating the high speed rotation of said drive shaft.

11. An extendible retractable barrier as recited in claim 10, wherein the rotation of said drive shaft rotates said drive chain thus propelling said screen upwards at a rapid rate.

12. An extendible retractable barrier as recited in claim 11, wherein said screen is extended rapidly enough to impede the projection of said ball towards said pitching mound thereby effectively protecting said pitcher from injury.

13. An extendible retractable barrier as recited in claim 12, wherein said housing further includes a timer mechanism thereby allowing said screen to remain in the extended position for a pre-determined period of time after deployment before said motor reverses and retracts said screen.

14. An extendible retractable barrier as recited in claim 1, wherein said housing includes a manual override to turn said sensors on and off and to extend and retract said screen as needed.

15. An extendible retractable barrier as recited in claim 1, further including a remote control device to allow the user to extend and retract said screen as needed from a remote location.

* * * * *